US005178651A

United States Patent [19]

Balma et al.

[11] Patent Number: 5,178,651

[45] Date of Patent: Jan. 12, 1993

[54] METHOD FOR PURIFYING GAS DISTRIBUTION SYSTEMS

[76] Inventors: Frank R. Balma, 38770 Moore Dr., Fremont, Calif. 94536; Brent D. Elliot, 1252 Santa Paula Ave., San Jose, Calif. 95110

[21] Appl. No.: 741,651

[22] Filed: Aug. 7, 1991

[51] Int. Cl.[5] ..... B01P 46/10

[52] U.S. Cl. ..... 55/20; 55/21; 55/80; 55/97; 55/269; 55/399; 392/489; 392/491

[58] Field of Search ..... 55/20, 21, 80, 97, 213, 55/217, 267, 269, 275, 385.2, 399; 392/485, 488, 489, 491

[56] References Cited

U.S. PATENT DOCUMENTS

| | | | |
|---|---|---|---|
| 3,777,117 | 12/1973 | Othmer | 392/485 X |
| 3,934,117 | 1/1976 | Schladitz | 392/488 X |
| 4,147,923 | 4/1979 | Davis et al. | 392/488 X |
| 4,197,095 | 4/1980 | White et al. | 55/275 X |
| 4,501,952 | 2/1985 | Lehrke | 392/491 |

*Primary Examiner*—Charles Hart
*Attorney, Agent, or Firm*—Flehr, Hohbach, Test, Albritton & Herbert

[57] ABSTRACT

An apparatus (10) for purifying gas distribution systems has a gas inlet (12) and a gas outlet (14) for connection to gas distribution lines (54). A housing (22) encloses a resistance heater (24) and a particle filter (26) for the gas. The resistance heater (24) is connected to the gas inlet (12) and the particle filter (26) is connected between the resistance heater (24) and the gas outlet (14). The resistance heater includes a sealed tube (26) defining a gas plenum (28). A resistance heater element enclosed in a cylindrical Inconel alloy shell (30) is centrally disposed in the sealed tube (26). A spiral ridge (32) winds around the shell (30) to define a spiral path for gas flowing through the plenum (28). The spiral ridge (32) has a narrower pitch near the gas inlet (12) and a wider pitch moving toward the filter (26) end of the plenum (28).

3 Claims, 4 Drawing Sheets

METHOD FOR PURIFYING GAS DISTRIBUTION SYSTEMS

BACKGROUND OF THE INVENTION

1. Field of the Invention

The present invention relates generally to the installation and maintenance of systems for distributing highly purified gases in controlled environments, such as integrated circuit manufacturing equipment. More particularly, it relates to an apparatus that will purify such distribution systems after their fabrication or maintenance procedures that introduce contamination to the gas distribution system.

2. Description of the Prior Art

The fabrication of integrated circuits requires the use of large quantities of purified gases, such as nitrogen, oxygen, hydrogen and helium that are as particle free as possible, used in a clean room or laminar flow hoods. The presence of contaminants, such as particulate matter or unwanted moisture in the gases will result in defective integrated circuits, either reducing yields of acceptable circuits or making it impossible to fabricate any circuits that meet specifications. In order to distribute the purified gases to an integrated circuit (IC) manufacturing equipment, a gas distribution system free of contaminants is required.

It is conventional practice in the industry to fabricate the components of the gas distribution system themselves in a clean room environment. However, when such components are assembled together to make the gas distribution system, working with pipes, including brazing or welding them, contaminates components which are initially free of contamination with particulate matter. Because it is impossible as a practical matter to carry out all of the gas distribution system assembly in a controlled environment, such as a glove box, unwanted moisture is also introduced into the gas distribution system. Particulate and moisture contamination is also introduced into existing purified gas distribution systems whenever those systems are disturbed, such as during maintenance or modification of the systems.

Conventional practice in the industry for eliminating such contamination is to run purified gas through the system until the output from the system is pure enough, e.g., until the moisture content and particulate level in the gas are low enough. This approach consumes large amounts of the purified gas in a wasteful manner until a steady state purified condition is reached. Such an approach is also time consuming, since it will often take considerable time, such as a matter of several days, before the steady state purified condition is reached. A need therefore exists for an improved apparatus and method for purifying such gas distribution systems.

SUMMARY OF THE INVENTION

Accordingly, it is an object of this invention to provide a method for purifying a gas distribution system that does not require supplying large quantities of purified gas through the system until the output of the system is pure enough.

It is another object of the invention to provide such a method that will purify a gas distribution system in substantially less time than is required by supplying purified gas through the system until the output of the system is pure enough.

The attainment of these and related objects may be achieved through use of the novel apparatus and method herein disclosed. An apparatus for purifying gas distribution systems in accordance with this invention has a housing and means in the housing for heating a gas for supply to the gas distribution system. A gas inlet is connected to supply the gas to the means for heating the gas. A filter is connected to receive the gas from the means for heating the gas. A gas outlet supplies the gas to the gas distribution system and is connected to receive the gas from the filter.

A method for purifying gas distribution systems in accordance with the invention includes connecting a heater through a filter to the gas distribution system. Gas is supplied to the heater. The gas is heated with the heater to produce heated gas. The heated gas is supplied to the filter. The heated gas is filtered with the filter to produce heated and filtered gas. The heated and filtered gas is flowed through the gas distribution system to an outlet. Moisture level and particulate level of the gas at the outlet are measured until predetermined moisture and particulate levels are obtained at the outlet. Flow of the heated and filtered gas through the gas distribution system ceases when the predetermined levels are obtained.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
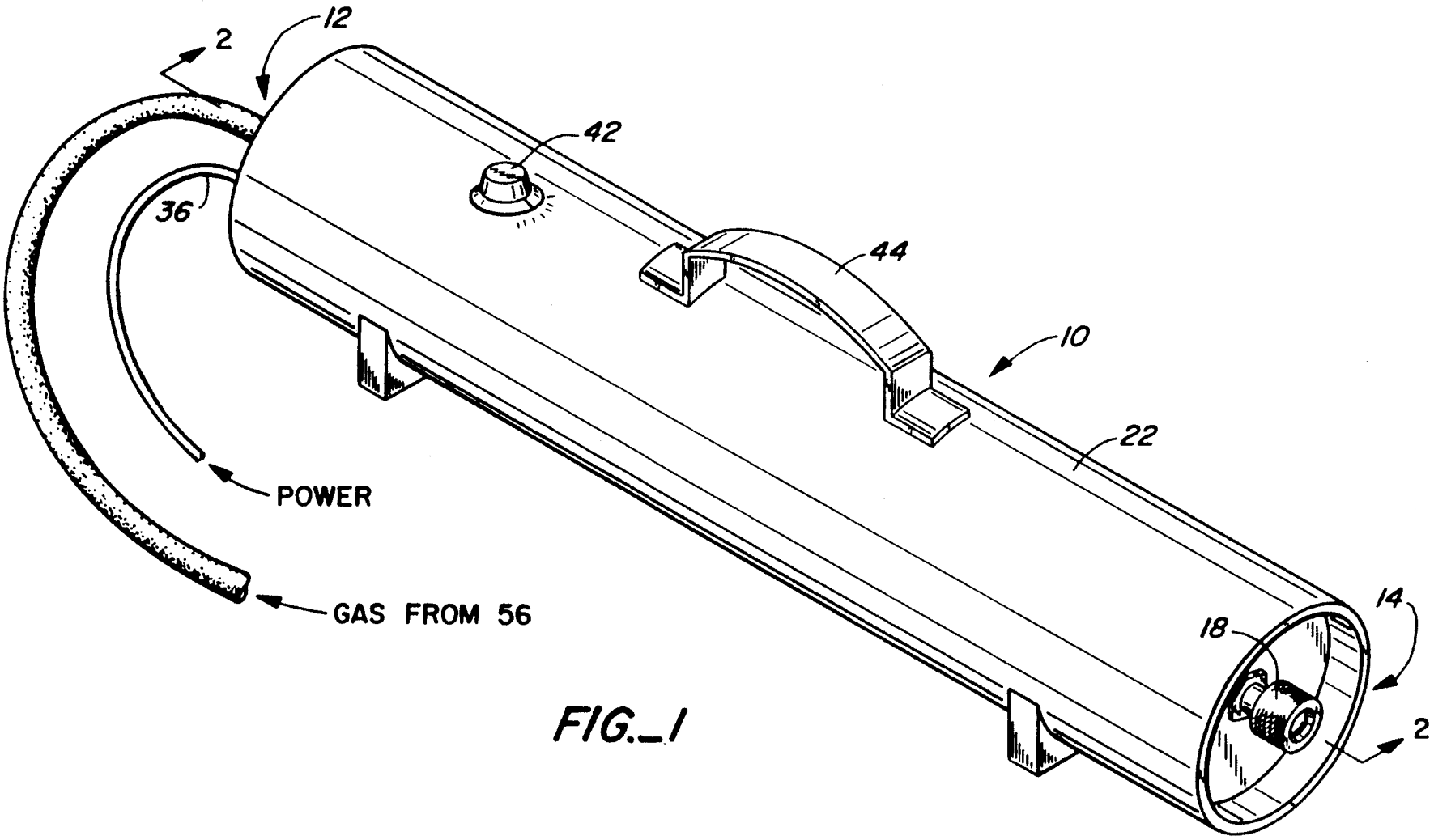
FIG. 1 is an external perspective view of an apparatus for purifying gas distribution systems in accordance with the invention.
Figure 2:
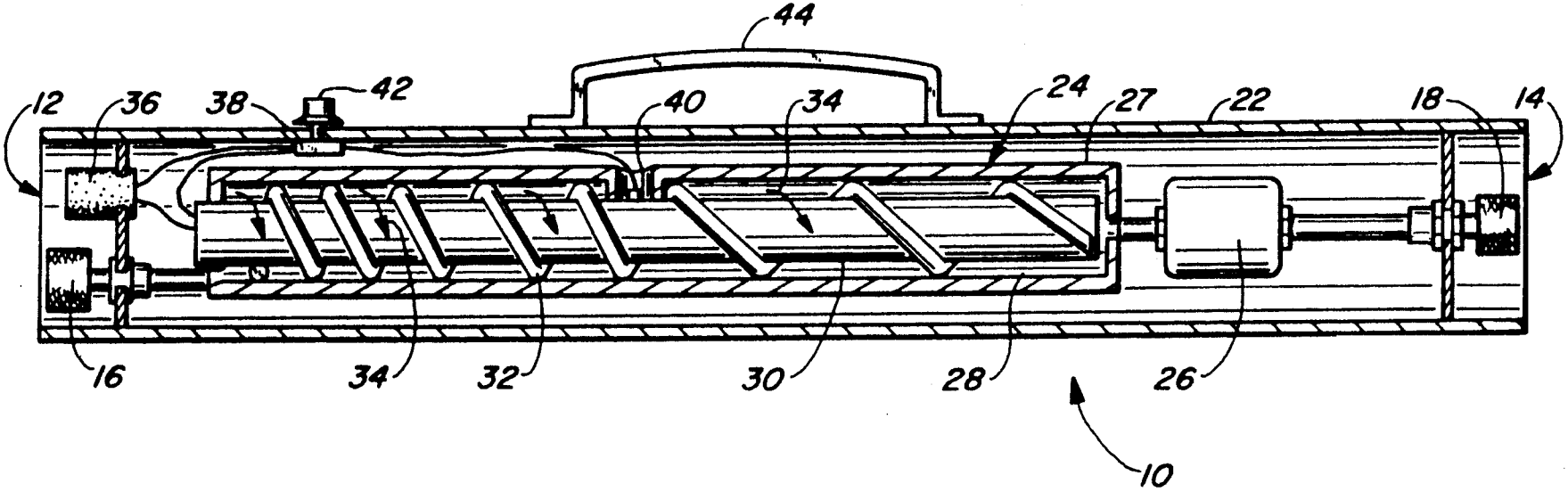
FIG. 2 is a cross section view, taken along the line 2—2 in FIG. 1.

Turning now to the drawings, more particularly to FIGS. 1-2, there is shown an apparatus 10 for purifying gas distribution systems. The apparatus 10 has a gas inlet 12 and a gas outlet 14 having suitable fittings 16 and 18 for connection to gas distribution lines 54. A housing 22 encloses a resistance heater 24 and a particle filter 26 for the gas. The resistance heater 24 is connected to the gas inlet 12 and the particle filter 26 is connected between the resistance heater 24 and the gas outlet 14.

The resistance heater includes a sealed tube 27 defining a gas plenum 28. A resistance heater element enclosed in a cylindrical Inconel alloy shell 30 is centrally disposed in the sealed tube 27. A spiral ridge 32 winds around the shell 30 to define a spiral path for gas flowing through the plenum 28, as indicated by arrows 34. The spiral ridge 32 has a narrower pitch near the gas inlet 12 and a wider pitch moving toward the filter 26 end of the plenum 28. This shape forces intimate contact between the gas and the heating element when the gas temperature difference compared to the heating element is greatest. An electrical power input 36 is connected to the resistance heater element through a rheostat control 38. A thermocouple 40 is positioned against the heater element shell 30 and is also connected to the rheostat control 38. Filter 26 is implemented with a sintered stainless steel type filter element, obtainable from various suppliers. A control knob 42 is connected for adjustment of the rheostat control 38. A handle 44 is provided on the housing 22 for transport of the apparatus 10. The housing 22 and the sealed tube 27 are fabricated from a 316L or 304 type stainless steel.

Figure 3:
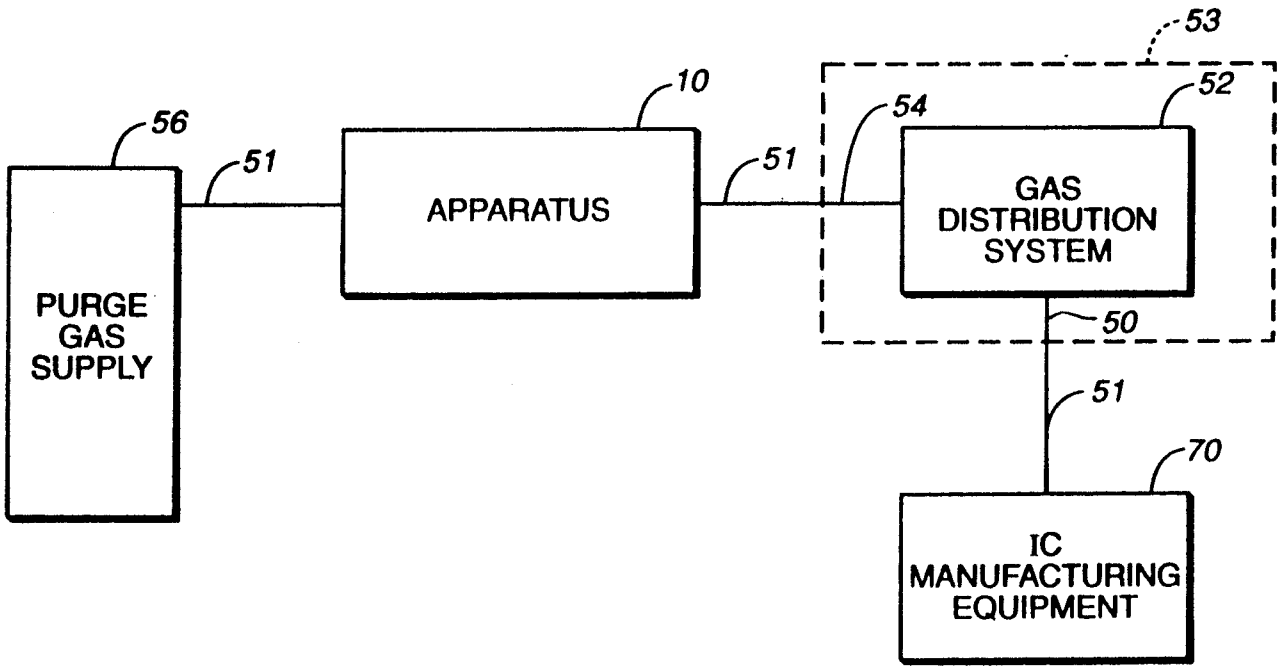
FIG. 3 is a block diagram of a gas distribution system undergoing purification with the apparatus of FIGS. 1-2.

In use, the apparatus 10 is connected by facility lines 51 as shown in FIG. 3 between purge gas source 56 and an inlet 54 of a gas distribution system 52 to be purified with the apparatus 10. The resistance heater 24 is energized, the purified gas is supplied to the system 52 from the apparatus 10 and the gas is circulated through the gas distribution system 52 until the moisture and particulate levels at the outlet 50 of the distribution system are low enough to meet a desired specification. The apparatus 10 is then disconnected from the system inlet 54 and the purge gas source 56.

Figure 4:
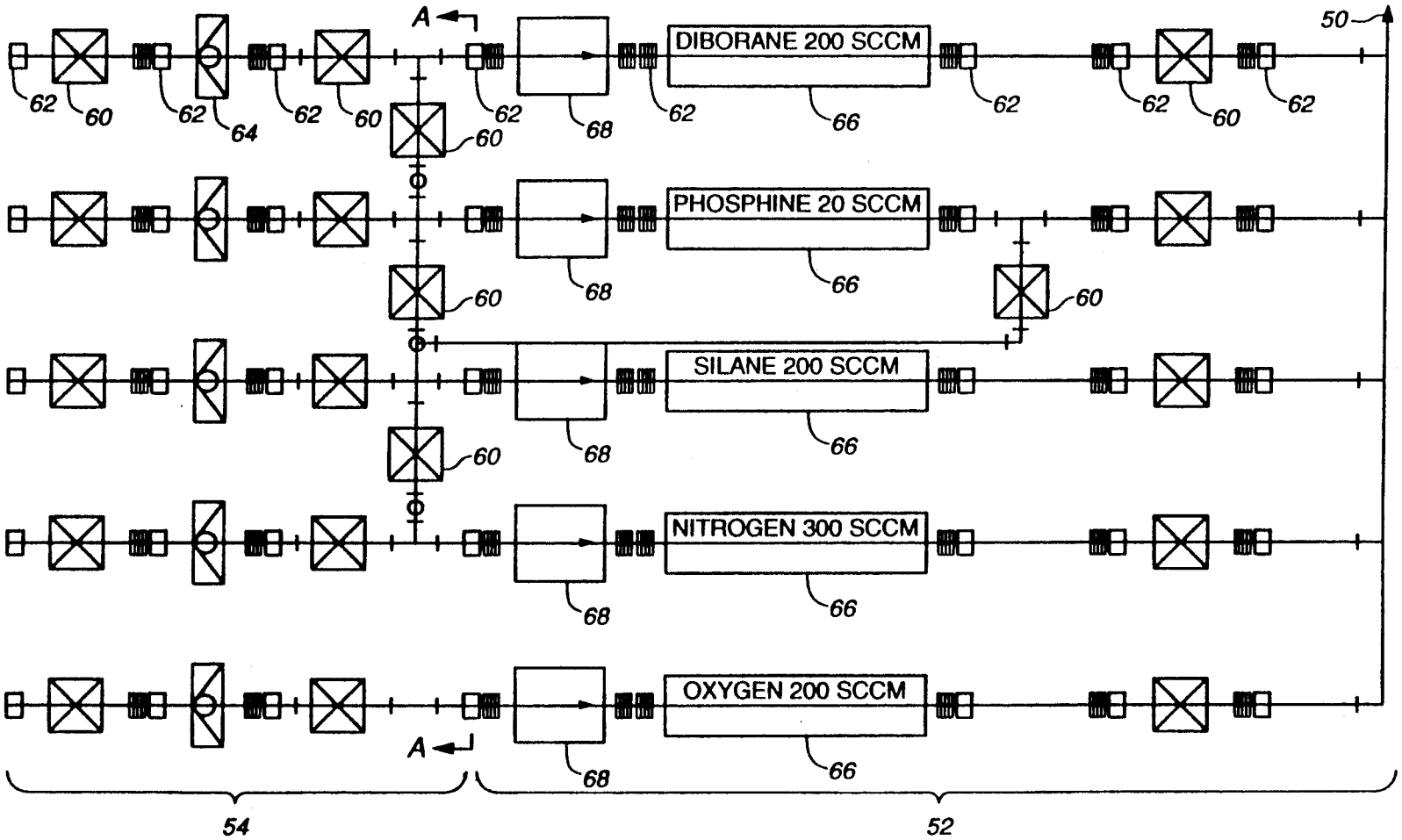
FIG. 4 is a diagram of the distribution inlet, the gas distribution system and the gas distribution system outlet as denoted by the dotted line box of FIG. 3.

FIG. 4 shows the distribution inlet 54, the gas distribution system 52 and the gas distribution system outlet 50 as denoted by the dotted line box 53 of FIG. 3. Inlet 54 having valves 60 connected by fitting ends 62 to check valves 64, typically divides the purified gas to different mass flow carriers 66 via filters 68. For clarity purposes, the numerals are only placed with respect to one portion of inlet 54, however are clearly applicable to each portion. FIG. 4 shows, for example, five different mass flow carriers 66. Outlet 50 then distributes the gas to IC manufacturing equipment 70 as shown in FIG. 3.

In a typical gas distribution system that has been contaminated with moisture and particulate matter during construction or maintenance of the gas distribution system, use of the apparatus 10 as described above will produce a moisture level of less than 10 PPBV in a time of about 20 minutes. This compares with a time of about two to four days when using the conventional approach of feeding purified gas through the gas distribution system until equivalent moisture and particulate contamination levels are reached.

It should now be readily apparent to those skilled in the art that a novel apparatus and method for purifying gas distribution systems capable of achieving the stated objects of the invention has been provided. The gas distribution system and method does not require supplying large quantities of purified gas through the system until the output of the system is pure enough. The apparatus and method will purify a gas distribution system in substantially less time than is required by supplying purified gas through the system until the output of the system is pure enough.

It should further be apparent to those skilled in the art that various changes in form and details of the invention as shown and described may be made. It is intended that such changes be included within the spirit and scope of the claims appended hereto.

What is claimed is:

1. A method for purifying a gas distribution system, which comprises connecting a heater through a filter to the gas distribution system, supplying gas to the heater, heating the gas with the heater to produce heated gas, supplying the heated gas to the filter, filtering the heated gas with the filter to produce heated and filtered gas, supplying the heated and filtered gas through the gas distribution system to an outlet, measuring moisture level and particulate level of the gas at the outlet until predetermined moisture and particulate levels are obtained at the outlet, and stopping flow of the heated and filtered gas through the gas distribution system when the predetermined levels are obtained.

2. The method of claim 1 in which the heater is an electrical resistance heater.

3. The method of claim 1 in which the gas is heated to a temperature of at least about 100° C.

* * * * *